US005624103A

United States Patent [19]

Venegas, Jr.

[11] Patent Number: 5,624,103

[45] Date of Patent: Apr. 29, 1997

[54] GUARD RAIL ASSEMBLY

[76] Inventor: Frank Venegas, Jr., 4165 Homestead, Howell, Mich. 48843

[21] Appl. No.: 714,018

[22] Filed: Sep. 12, 1996

Related U.S. Application Data

[63] Continuation of Ser. No. 368,593, Jan. 4, 1995, abandoned.

[51] Int. Cl.[6] ..... E04F 11/18

[52] U.S. Cl. ..... 256/66; 256/19

[58] Field of Search ..... 256/19, 59, 65, 256/66

[56] References Cited

U.S. PATENT DOCUMENTS

| | | | |
|---|---|---|---|
| 4,461,461 | 7/1984 | Caron | 256/19 |
| 4,930,754 | 6/1990 | Caron et al. | 256/19 X |
| 4,953,830 | 9/1990 | Weaver, III | 256/19 X |
| 5,035,401 | 7/1991 | Solter | 256/19 |
| 5,161,784 | 11/1992 | Sader | 256/19 X |
| 5,261,647 | 11/1993 | Venegas, Jr. et al. | 256/19 X |

*Primary Examiner*—Anthony Knight

*Attorney, Agent, or Firm*—Gifford, Krass, Groh, Sprinkle, Patmore, Anderson & Citkowski, P.C.

[57] ABSTRACT

A guard rail assembly formed of at least two vertical rails and a horizontal rail extending above the vertical rails and supported by the vertical rails. The vertical rails are spaced sufficiently apart to prevent passage of a child's head therein between the vertical rails. Both horizontal and vertical rails preferably include polymerized sheathing about the rails to protect the rails from the environment.

6 Claims, 1 Drawing Sheet

GUARD RAIL ASSEMBLY

This is a continuation of application Ser. No. 08/368,593 filed on Jan. 4, 1995, now abandoned.

BACKGROUND OF THE INVENTION

I. Field of the Invention

The present invention relates to a guard rail assembly. More particularly, the present invention relates to a the guard rail assembly having vertical rails spaced sufficiently apart to prevent the passage of a child therethrough. Further, the guard rail assembly has polymerized sheathing extending about the exterior of the assembly for protecting the rails from the environment.

II. Description of the Relevant Art

Typically, guard rail assemblies are formed of metal bars having horizontal and vertical rails permanently affixed to each other. A disadvantage of these previously known structures is that the metal rail may rust from being exposed to the environment. A further disadvantage of a metal rail structure is that any damage done to the rail, such as bending or puncturing the rod by a collision with a vehicle, for instance, will cause irreparable damage to the guard rail assembly. The whole assembly must then be replaced or repainted to prevent the metal from rusting.

A still further disadvantage of these previously known guard rail assemblies is that the rail is generally configured in such a manner that at least two vertical support stanchions extend parallel to one another and have a series of horizontal rails extending between the stanchions. A disadvantage of these previously known rail assemblies is that children may use the horizontal rails ladder rungs and climb the guard rail assembly, thereby gaining access to the guarded area. A still further disadvantage of this guard rail configuration is that smaller children may climb through the horizontal railing to also gain access to the guarded area.

SUMMARY OF THE PRESENT INVENTION

The present invention provides a guard rail assembly which overcomes the disadvantages of the previously known guard rail assemblies.

The guard rail assembly of the present invention is preferably formed of at least two vertical rails and a horizontal rail extending above the vertical rails and supported by the vertical rails. The vertical rails are spaced sufficiently apart to prevent the passage of a child therethrough.

The guard rail assembly of the present invention is also provided with polymerized sheathing that extends about the vertical and horizontal railing. The polymerized sheathing protects the rail from the environment and eliminates the need to paint the metal rail. The polymerized sheathing may be provided in any color and support any type of advertisement required. A further advantage of the polymerized sheathing is that the sheathing absorbs any exterior forces, such as a vehicle crashing into the guard rail assembly, thereby eliminating or minimizing any damage to the guard rail assembly.

Other advantages and features of the present invention will become more apparent from the following detailed description when read in conjunction with the accompanying drawing.

BRIEF DESCRIPTION OF THE DRAWING

The present invention will be more fully understood by reference to the following detailed description of the preferred embodiments of the present invention when read in conjunction with the accompanying drawing, in which like reference characters refer to like parts throughout the views, and in which.

DETAILED DESCRIPTION OF THE PREFERRED EMBODIMENTS OF THE PRESENT INVENTION

Figure 1:
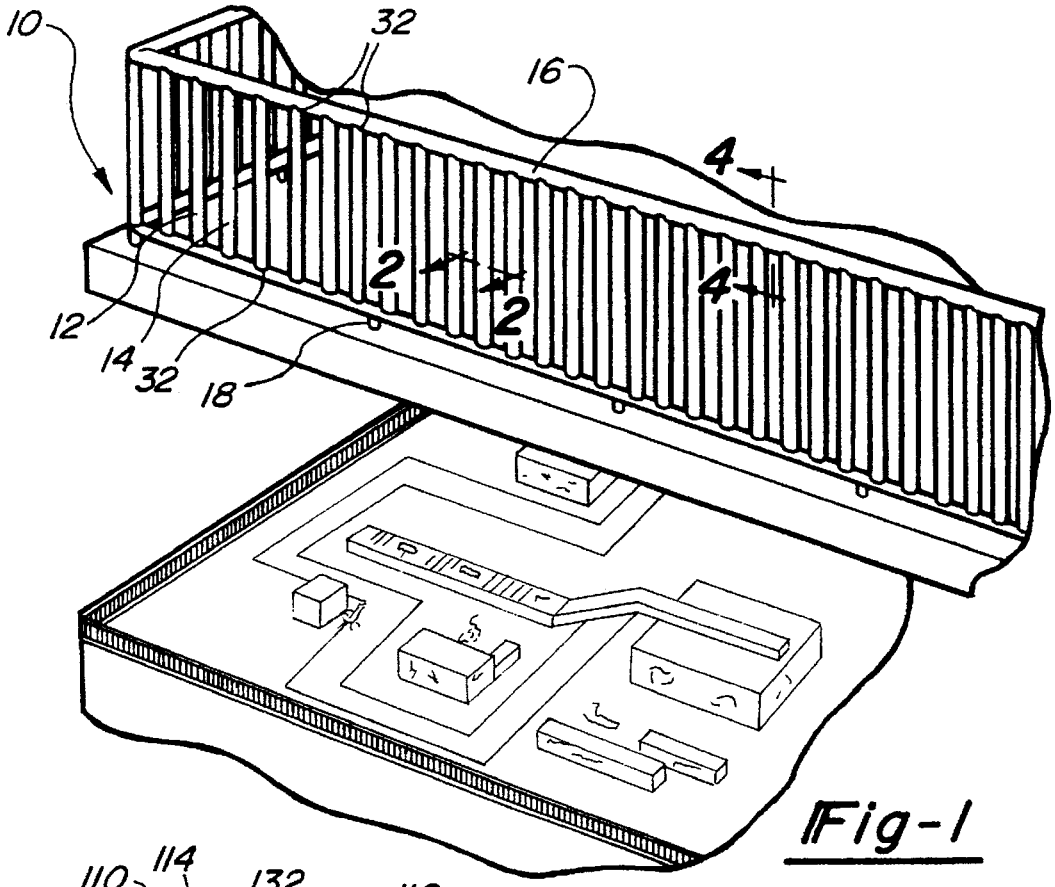
FIG. 1 is a perspective view illustrating a preferred embodiment of the present invention.

With reference first to FIG. 1, a first preferred embodiment of the guard rail assembly 10 of the present invention is thereshown. Guard rail assembly 10 is formed of at least two vertical rails 12, 14 and horizontal rails 16, 18 supported above and below vertical rails 12, 14, respectively.

Figure 3:
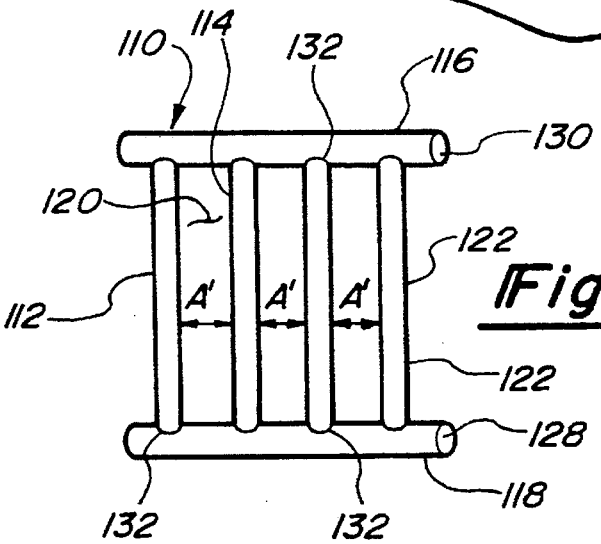
FIG. 3 is a perspective illustrating a second preferred embodiment of the present invention.

As best shown in FIGS. 1 and 3, vertical rails 12, 14 are spaced equally apart a distance A to prevent the passage of a child, and particularly a child's head, through the interior area 20 between vertical rails 12, 14. Spacing A is preferably equal to or less than four inches. Four inches is set forth by the BOCA (Building Officials and Code Administrators) regulations as being a space small enough to prevent the average child from placing their head therethrough.

Figure 2:
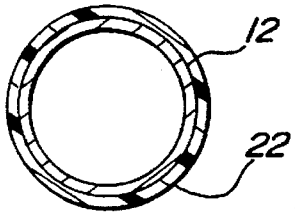
FIG. 2 is a cross-sectional view of FIG. 1.

With reference now to FIG. 2, a cross-sectional view of vertical rails 12, 14 of the preferred embodiment is thereshown. In a preferred embodiment of the invention, vertical rail 12 includes a polymerized sheath 22 extending about the exterior of rail 12.

Figure 4:
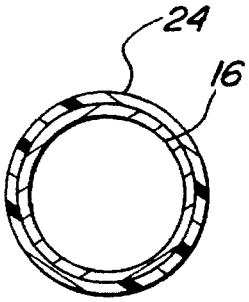
FIG. 4 is a cross-sectional view of FIG. 3.

With reference to FIG. 4, a cross-sectional view of horizontal rail 16 is thereshown. In a preferred embodiment of the invention, horizontal rail 16 is preferably sheathed with a polymerized material 24 similar to polymerized sheathing 22 shown in FIG. 2. Polymerized sheathing 22, 24 protects the horizontal and vertical railing from the environment. Thus, the polymerized sheathing 22, 24 eliminates the need for repainting guard rail assembly 10 due to rust from the environment. Polymerized sheathing 22, 24 also protects the guard rail assembly 10 from damage by absorbing shock to the assembly by any moving objects, such as vehicles.

With reference now to FIG. 3, a second preferred embodiment of the invention is thereshown. Guard rail assembly 110 again is formed of two vertical rails 112, 114 preferably having polymerized sheathing 122 extending about the exterior of vertical rails 112, 114. Horizontal rails 116, 118 extend above and below vertical rails 112,114, respectively and are supported by these same rails. This guard rail assembly is a movable assembly, rather than the fixed assembly shown in FIG. 1. As previously described, the area between vertical rails 112, 114 defined as A' is a space sufficient to prevent the passage of a child, particularly a child's head, through the area 120. Spacing A' is preferably four inches or less as recited by the BOCA regulations as a space substantially adequate to prevent the average child from climbing through area 120. End caps 128, 130 preferably formed of polymerized material may be provided at each end of horizontal rails 116, 118 to enclose the interior area of the horizontal rails thus ensuring that the rail will not rust from the inside out. End caps 128, 130 are readily removable if necessary.

To construct the assemblies shown in FIGS. 1 and 3, polymerized sheathing 22, 24, 122, 124 is placed about vertical rails 12, 14, 112, 114. Polymerized sheathing 22, 24, 122, 124 is also placed about horizontal rails 16, 18, 116, 118. Horizontal rails with sheathing is provided with openings 32,132 corresponding to the desired spacing and fixation of vertical rails 12, 14, 112,114 to horizontal rails 16, 18, 116, 118. The vertical rails with sheathing are fixedly mounted to the horizontal rails with sheathing at the designated spacing. End caps 128, 130 are then slid within the end of horizontal rails 116, 118 if desired to completely seal the assembly.

Having described my invention, however, many modifications thereto will become apparent to those skilled in the art to which it pertains without deviation from the spirit of the invention as defined by the scope of the appended claims.

I claim:

1. A guard rail assembly comprising:

two spaced apart hollow metal horizontal rails;

a hollow polymerized sheathing extending the length of each of said horizontal rails and having an interior diameter slightly greater than the outer diameter of each of said horizontal rails so that said sheathing slip fits around each of said horizontal rails;

a pair of spaced apart metal vertical rails extending between said horizontal rails;

a hollow polymerized sheathing extending the length of each of said vertical rails and having an interior diameter slightly greater than the outer diameter of each of said vertical rails so that said sheathing slip fits around each of said vertical rails;

wherein said space between said vertical rails is no greater than four inches.

2. The guard rail assembly defined in claim 1 wherein one of said horizontal rails is removably mounted to the ground no higher than four inches from the ground and the outer diameter of said horizontal rail.

3. A guard rail assembly comprising:

a rail assembly unit;

each unit comprising:

two spaced apart hollow metal horizontal rails;

hollow polymerized sheathing extending the length of each of said horizontal rails and having an interior diameter slightly greater than the outer diameter of each of said horizontal rails so that said sheathing slip fits around each of said horizontal rails;

a pair of spaced apart metal vertical rails extending between said horizontal rails;

a hollow polymerized sheathing extending the length of each of said vertical rails and having an interior diameter slightly greater than the outer diameter of each of said vertical rails so that said sheathing slip fits around each of said vertical rails;

wherein said space between said vertical rails is no greater than four inches;

wherein one of said horizontal rails rests on the ground to prevent passage of a child between the ground and said horizontal rail.

4. The guard rail assembly defined in claim 3 wherein said pair of horizontal rails further comprises an end cap for each end of said horizontal rails and having an outer diameter equal to the inner diameter of said polymerized sheathing.

5. The guard rail assembly defined in claim 4 wherein said end caps are formed of a polymer material.

6. The guard rail assembly defined in claim 4, each of said end caps further comprising an opening provided within the outer diameter of said end cap for removing said end cap from said horizontal rails.

* * * * *